United States Patent [19]

Beer et al.

[11] Patent Number: 4,707,221

[45] Date of Patent: Nov. 17, 1987

[54] SHEETS HAVING IMPROVED STIFFNESS FROM FIBER, LATEX AND COALESCING AGENT

[75] Inventors: James J. Beer; Do I. Lee, both of Midland, Mich.

[73] Assignee: The Dow Chemical Company, Midland, Mich.

[21] Appl. No.: 592,507

[22] Filed: Mar. 26, 1984

Related U.S. Application Data

[63] Continuation-in-part of Ser. No. 452,582, Dec. 23, 1982, abandoned.

[51] Int. Cl.[4] ..... D21H 3/02; D21H 3/32

[52] U.S. Cl. ..... 162/158; 162/168.1; 162/169; 162/183

[58] Field of Search ..... 162/169, 170, 168.1, 162/135, 146, 183, 181.1, 158, 181.3

[56] References Cited

U.S. PATENT DOCUMENTS

| | | | |
|---|---|---|---|
| 3,055,853 | 9/1962 | Pickell | 162/169 |
| 3,102,837 | 9/1963 | Griswold | 162/169 |
| 3,184,373 | 5/1965 | Arledter | 162/181.8 |
| 3,203,851 | 8/1965 | Blau et al. | 162/168.1 |
| 3,325,345 | 6/1967 | Hider | 162/169 |
| 4,002,527 | 1/1977 | Piersol | 162/169 |
| 4,032,392 | 6/1977 | Koller | 162/169 |
| 4,178,205 | 12/1979 | Wessling et al. | 162/168.1 |
| 4,225,383 | 9/1980 | McReynolds | 162/156 |
| 4,246,066 | 1/1981 | Amano et al. | 162/169 |
| 4,325,856 | 4/1982 | Ishikawa et al. | 428/514 |
| 4,426,470 | 1/1984 | Wessling et al. | 162/135 |
| 4,445,970 | 5/1984 | Post et al. | 162/181.1 |

FOREIGN PATENT DOCUMENTS

| | | | |
|---|---|---|---|
| 619559 | 5/1961 | Canada | 162/169 |
| 1135460 | 11/1982 | Canada | 162/181.1 |
| 461558 | 7/1936 | United Kingdom | 162/170 |

*Primary Examiner*—Peter Chin

[57] ABSTRACT

A process for preparing a sheet with improved stiffness by mixing a fiber, a latex having minimum film forming conditions greater than the conditions the sheet reaches during drying and a fugitive coalescing agent. The mixture is collected and dried under conditions less than the minimum film forming conditions of the latex. The process enables hard latexes to be employed which do not form films under the drying conditions of the sheet whereby the hard latexes can contribute to the stiffness of the final sheet. A sheet prepared by the process is also provided.

4 Claims, No Drawings

SHEETS HAVING IMPROVED STIFFNESS FROM FIBER, LATEX AND COALESCING AGENT

RELATED U.S. APPLICATION DATA

This application is a continuation-in-part of U.S. Ser. No. 452,582, filed Dec. 23, 1982 abandoned.

BACKGROUND OF THE INVENTION

The present invention generally relates to sheets prepared from fiber, latex and a coalescing agent. Further, the present invention provides for a sheet having improved stiffness by employing a hard latex and a fugitive coalescing agent.

A wide variety of sheets made from fibrous materials have been described in the art. Typical examples of such sheets include fine printing papers, cardboard papers, underlayment felt for vinyl floor coverings, gasket papers, roofing papers, sound-deadening papers, pipewrap, heat deflection papers and board products.

In an effort to improve the properties of these products, various latex compositions have been employed. While such practices have greatly contributed to the art, it is still desirable to have further improvements in their physical properties such as stiffness.

Stiffness is very important in printing grades of paper, especially in the lightweight grades. Methods to increase sheet stiffness are therefore desirable. One potential method for increasing stiffness would be to employ a latex having greater hardness; however, use of such a latex would be limited by its ability to coalesce or form a film under the sheet preparation conditions. That is, a latex with a minimum film forming temperature greater than the temperature a sheet reaches during preparation would not be a viable choice. Unfortunately, such latexes could provide the desired stiffness but increasing the drying temperature would be harmful to the fiber and other organic components of the sheet system. Therefore, it would be desirable to be able to employ a latex having minimum film forming conditions greater than the sheet preparation conditions in order to take advantage of the latex's physical properties (i.e., hardness which could translate to increased stiffness when used in a sheet system).

U.S. Pat. No. 4,225,383 generally teaches composite sheet preparation and suggests polymers which are made film forming by the use of plasticizers can be used. This reference is, however, limited to composite sheets containing relatively high levels of filler or pigment from 60 to about 95 percent based on the dried weight of the composite sheet. The subject invention, instead, focuses on sheets with no filler or medium filler levels.

SUMMARY OF THE INVENTION

The present invention provides a process for preparing a sheet with improved stiffness which comprises: (a) mixing in an aqueous medium a mixture comprising (i) a fiber, (ii) a latex having minimum film forming conditions greater than the conditions the sheet reaches during drying, and (iii) a fugitive coalescing agent (b) forming the mixture into a sheet, and (c) drying said sheet under conditions less than the minimum film forming conditions required by the latex. Additionally, the process can include the step of mixing the latex with the fugitive coalescing agent prior to the addition of the fiber in the aqueous medium.

Further, the present invention may include the addition of a pigment or filler to the aqueous mixture of the process from about 0 to about 60 weight percent based on the total dry weight of the sheet. Additionally, the latex can be destabilized by combining a chemical flocculant to form the sheet.

The present invention further provides for a sheet prepared from the aforementioned process. An advantage of the sheet is improved stiffness for various grades of paper, especially fine printing paper.

DETAILED DESCRIPTION OF THE INVENTION

The process of the invention requires a fiber, a latex and a coalescing agent. More particularly, a fugitive coalescing agent is employed. The process can further comprise the incorporation of fillers from low to medium levels (0 to about 60 weight percent based on the total weight of the dried sheet) which are generally known in the art of sheet preparation.

As a first component, the process of the invention requires a fiber material. The fiber can be a water-insoluble, natural or synthetic water-dispersible fiber or blend thereof. Either long or short fibers, or mixtures of both, are useful. The most common natural fibers are those made from wood pulp, cotton, wool and jute to name only a few. Typically, synthetic fibers useful in the subject invention comprise rayon, nylon, glass fibers and polyester. More examples of other suitable fiber material are disclosed in U.S. Pat. No. 4,225,383.

The fiber is present in a reinforcing amount. That is, sufficient fiber will be present to impart additional physical strength to the sheet, compared to a similar sheet prepared without a fiber. Generally, the sheet will contain from about 1 to about 99, preferably from about 10 to about 80, more preferably from about 15 to about 70 weight percent fiber based on the total weight of the dried sheet.

As a second component, the process of the invention requires a latex. By the term "latex" is meant a colloidally stable dispersion of discrete polymer particles in an aqueous medium. The latex employed in the subject invention is critical to imparting the desired stiffness to the sheet. Therefore, the latexes are termed "hard latexes" which is meant to describe a latex having a relatively high minimum film forming temperature. That is a higher temperature than the sheet normally reaches at drying or due to the higher minimum film forming temperature, the latex does not have sufficient residence time to adquately coalesce under normal sheet preparation conditions. More particularly, these so called "hard latexes" are non-film forming under sheet process conditions. "Non-film forming" is meant to indicate a degree of latex coalescence. Sheet preparation "conditions" is meant to indicate the various parameters which effect the ability of a latex to coalesce such as temperature, residence time and moisture level. Because the hard latex would not generally form a film (i.e., coalesce) the third component of the subject invention is required which is a fugitive coalescing agent.

The latexes employed in the subject invention are water-insoluble, natural or synthetic and may be homopolymers or copolymers of two or more ethylenically unsaturated monomers or a mixture of such polymers. Monovinylidene aromatic compounds such as styrene and aliphatic conjugated dienes such as 1,3-butadiene are preferred latexes. Generally, the more preferred latexes comprise styrene/butadiene. Other suitable latexes generally known in the art of sheet preparation can also be advantageously employed as described herein. Suitable latexes are disclosed in U.S. Pat. No. 4,225,383.

The latex will be present in an amount sufficient to maintain the finished sheet in the form of a generally unitary sheet having sufficient body to enable it to be handled without crumbling. Preferably, there is sufficient latex present to allow the dried sheet to be put on rolls, coated, cut and printed without crumbling or tearing. Generally, the sheet will have from about 1 to about 30, preferably from about 1.5 to about 10, more preferably from about 2 to about 7, weight percent based on the total weight of the dried sheet.

As a third component, the subject process requires a coalescing agent. More particularly, the coalescing agent must be a fugitive coalescing agent. Therefore, unless otherwise indicated the term "coalescing agent" is meant to indicate a fugitive coalescing agent. By "fugitive" is meant that the coalescing agent is sufficiently volatile such that under the conditions employed to form and dry the sheet, the coalescing agent will be substantially removed from the sheet. Useful coalescing agents include glycol ethers such as ethylene glycol monomethyl ether, ethylene glycol monoethyl ether, ethylene glycol monobutyl ether, diethylene glycol monobutyl ether, diethylene glycol diethyl ether, and propylene glycol phenol ether; glycol ether acetates such as diethylene glycol monoethyl ether acetate and ethylene glycol monomethyl ether acetate; and ketones such as acetone, methyl ethyl ketone, methyl propyl ketone, and diacetone alcohol.

The coalescing agent is present in an effective amount. That is, sufficient coalescing agent will be present to assist in the deformation of the latex particles such that the finished sheet has greater stiffness than a similar sheet made without the use of a coalescing agent. Generally, the coalescing agent will be present from about 1 to about 20, preferably from about 2.5 to about 15, more preferably from about 5 to about 10 weight percent based on the total weight of the latex solids.

The fugitive coalescing agent is preferentially present in the latex particle as opposed to the aqueous phase of the mixture. In the latex particle the coalescing agent assists the hard latex to deform or coalesce on the fiber or pigments if present. In effect, the hard latex is, thus, made film forming under drying conditions less than the minimum film forming conditions required by the hard latex. Further, during the drying of the sheet, the fugitive coalescing agent is substantially removed whereby the hard latex reverts and contributes to the stiffness of the final sheet. Trace amounts of fugitive coalescing agent may, however, remain in the final sheet.

The invention also includes "composite papers" which are nonwoven fabrics containing a binder, a fiber, and a nonbinding filler. These fillers are generally finely divided solids (i.e., powders) such as clay, magnesium hydroxide, or calcium carbonate. Examples of other suitable fillers are disclosed in U.S. Pat. No. 4,225,383.

For use in the subject invention, the filler level is from 0 to about 60 weight percent based on the weight of the dried sheet. The preferred filler range is from about 25 to about 45 weight percent. Lower filler levels can be advantageously employed due to the excellent physical properties contributed by the hard latex.

Generally, the fiber, latex, coalescing agent and optional filler are combined in an aqueous medium prior to formation of the sheet. While not critical to the practice of the invention, it is generally convenient to premix the latex and coalescing agent, and add this mixture to a dispersion of the fiber and filler in water. In preparing the latex-coalescing agent mixture, it is desirable to provide a standing period so that the coalescing agent may have time to diffuse into the latex particles. Normally, a period of about one hour is sufficient. If the latex and coalescing agent are added separately to the fiber slurry, an extensive waiting period (perhaps several days or more) may be needed unless very large amounts of coalescing agent are used.

After the fiber, latex and coalescing agent have been combined in the aqueous medium, the latex is destabilized so as to precipitate it onto the fibers. This is conveniently accomplished by means of a flocculating (coagulating) agent. As the flocculant, substances capable of destabilizing the latex dispersion can be used. Examples of suitable flocculants include modified cationic polyacrylamide and diallyldiethylammonium chloride for anionic latexes and partially hydrolyzed polyacrylamide for cationic latexes.

After flocculation is completed, the aqueous slurry is formed into a sheet or web and dewatered. This sheet forming and dewatering process may be accomplished by any conventional paper-making apparatus such as a sheet mold, or a Fourdrinier or cylinder machine.

After the composite is formed into a dewatered sheet, it may be desirable to densify the sheet by pressing it with a flat press or by sending it through calendering rolls. Drying of the sheet may be either by air drying at ambient conditions or by oven drying.

The drying temperature of a sheet is limited by the temperature at which the fiber or other organic component of the system can withstand without being damaged. Thus, heretobefore, a latex selection was generally limited by the minimum film forming temperature of the latex. Therefore, an advantage of the present invention is that for a given drying temperature, a harder latex may be used or for a given latex, the composite may be dried at a lower temperature.

Other general teachings of the use of latexes in the formation of fibrous sheets may be found, for example, in U.S. Pat. Nos. 3,875,097 and 3,518,113, and West German issued Pat. No. 1 446 609.

A particularly useful and commercially significant embodiment of the invention includes a composite made with a latex, a high grade cellulose fiber, a filler, and a fugitive coalescing agent, wherein the finished composite is relatively thin (i.e., from about 0.002 to about 0.01 inches (about 0.05 to about 0.25 mm)). These composites generally will contain desirably about 3 to about 99, preferably about 25 to about 90, most preferably about 35 to about 70, weight percent fiber based on the total weight of the dried composite; desirably about 0 to about 60, preferably from about 25 to about 45, weight percent filler based on the weight of the dried composite; and desirably from about 0.5 to about 30, preferably from about 0.8 to about 10, more preferably from about 1 to about 5, weight percent (based on solids) of the latex, based on the total weight of the dried composite. Such composites are useful as printing papers, and have unexpectedly superior stiffness compared to similar papers made without the fugitive coalescing agent.

The invention is further illustrated by the following examples. In the examples all parts and percentages are by weight unless otherwise specified.

Example 1—Fine Printing Paper

A. Pulp Preparation

A mixture of 50 parts kraft hardwood and 50 parts kraft softwood is dispersed in water at 1.35 percent consistency and mechanically refined into pulp having 392 CSF (Canadian Standard Freeness). The pulp is then diluted to 0.51 percent consistency. On the following day, the pulp is adjusted to a pH of about 4.1 with 0.1 N HCl.

B. Latex Preparation

A relatively hard latex is prepared from 80 parts styrene, 17 parts butadiene and 2 parts acrylic acid using conventional emulsion polymerization techniques. The resulting latex is filtered to remove any coagulum, and has about 48 percent solids. To 100 wet grams of latex (45 percent solids), 4.5 g of propylene glycol phenyl ether are added, and mixed for at least 1 hour.

C. Sheet Preparation

In a large beaker, 444 wet grams (0.5 percent solids) of pulp are thoroughly mixed with 1.3 g of kaolin filler clay and 0.18 g of the above-prepared latex are added. After stirring is complete (about 3 minutes), cationic polyacrylamide (flocculating agent) is added until water phase clarity occurs, and then an additional 0.5 pounds/ton (0.025 percent) of Betz 1260 (high molecular weight polyacrylamide) is added. The dispersion is then immediately poured into a Noble and Wood sheet mold (8 in ×8 in (203 mm ×203 mm)) having about 5 liters of pH 4.0 water therein, and then additional water is added to bring the total volume in the mold to about 10.5 liters. The mold is then drained, and the sheet pressed and removed from the screen. The sheet is drum dried at about 160° F. (71° C.) for 330 seconds. The moisture content of the dried sheet is about 4 percent.

D. Evaluations

After aging for 1 day at 50 percent RH and 73° F. (22.8° C.) (TAPPI method T-402-05-70), the sheets are evaluated for rigidity on a Licence Kodak Pathe tester using 0.5 in (12.7 mm) wide test strips. The results are shown in the Table which follows.

E. Comparisons

For comparative purposes, two other papers, Samples 2 and 3, were made. Sample 2 was identical to the above-described paper, except that it is made without the propylene glycol phenyl ether coalescing agent. Sample 3 did not contain a coalescing agent and was made from a softer latex which is a blend of 40 percent of an 81 percent styrene, 17 percent 1,3-butadiene, 2 percent acrylic acid latex, and 60 percent of a latex comprising 49 percent styrene, 50 percent 1,3-butadiene, and 1 percent itaconic acid. The results are also shown below.

FINE PRINTING PAPER

| Sample | Latex | Coalescing Agent | Rigidity |
|---|---|---|---|
| 1 | hard | yes | 35.7 |
| 2* | hard | no | 28.6 |
| 3* | soft/hard blend | no | 27.7 |

*Not an example of the invention.

What is claimed is:

1. A process for preparing printing paper having improved stiffness which comprises: (a) mixing in an aqueous medium a mixture comprising:

(i) a fiber, (ii) a latex having minimum film forming conditions greater than the conditions the sheet reaches during drying, (iii) a fugitive coalescing agent, and (iv) a filler or pigment from about 25 to about 45 weight percent based on the weight of said printing paper;

(b) forming said mixture into a sheet; and (c) drying said sheet under conditions less than the minimum film forming conditions required by said latex.

2. The process of claim 1 which additionally includes the step of mixing said latex with said fugitive coalescing agent prior to the addition of said fiber in said aqueous medium.

3. The process of claim 1 wherein the sheet is formed by destabilizing said latex with a chemical flocculant 4. The process of claim 1 wherein the fugitive coalescing agent is a glycol ether.

* * * * *